US006505859B1

(12) United States Patent
Josephson

(10) Patent No.: US 6,505,859 B1
(45) Date of Patent: Jan. 14, 2003

(54) POLY-MATERIAL ENVELOPE ORGANIZER FOR RECEIPTS, COUPONS, AND/OR PACKAGE (RECYCLABLE) FOR FLAT PRODUCTS

(76) Inventor: Joanna Joy Matranga Josephson, 225 Montana Del Lago, Rancho Santa Margarita, CA (US) 92688

( * ) Notice: Subject to any disclaimer, the term of this patent is extended or adjusted under 35 U.S.C. 154(b) by 0 days.

(21) Appl. No.: 09/483,941

(22) Filed: Jan. 18, 2000

(51) Int. Cl.[7] ..... B42D 15/00

(52) U.S. Cl. ..... 283/116; 283/51; 281/38; 281/31; 229/70

(58) Field of Search ..... 283/116, 51; 402/79, 402/70, 73; 281/38, 31, 37; 229/70, 72

(56) References Cited

U.S. PATENT DOCUMENTS

| | | | | |
|---|---|---|---|---|
| 4,602,734 A | * | 7/1986 | Thompson | 283/116 X |
| 5,125,561 A | * | 6/1992 | Idstein | 283/116 X |
| 5,487,566 A | * | 1/1996 | Hedge, Jr. | 283/116 X |
| 5,657,869 A | * | 8/1997 | Carroll, III | 283/116 X |

* cited by examiner

*Primary Examiner*—Willmon Fridie, Jr.

(57) ABSTRACT

My invention is a portfolio to contain small papers in an orderly fashion with index tab dividers that enables categorical filing of coupons and receipts or any other small paper documents. The invention is constructed of polypropylene material and is generally the size of a large standard and/or small standard envelope of which size is generally 4 inches by 9 inches and 4 inches by 6 inches respectively.

1 Claim, 5 Drawing Sheets

Figure 1:
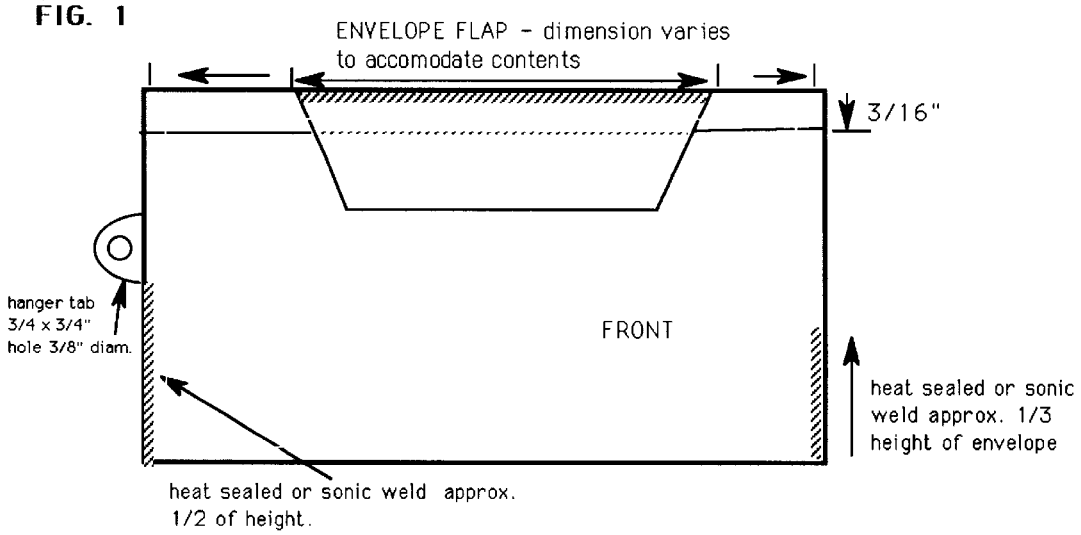
Figure 1A:
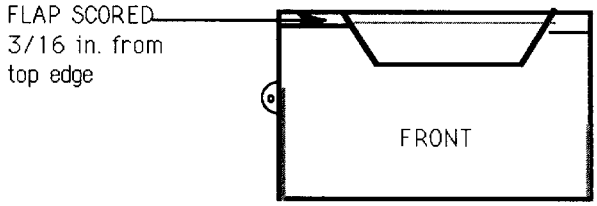
Figure 1B:
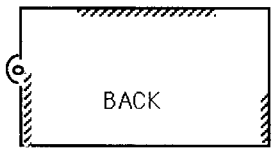

ENVELOPE ORGANIZER-for receipts, coupons, etc.

*POLYPROPYLENE and/or other poly material*

*Dimensions will Vary-(Dimensions shown are for example only)*

ENVELOPE ORGANIZER
COUPONS, RECEIPTS
(continued)

ECOLOGICAL PACKAGING ENVELOPE
*(DIMENSIONS WILL VARY)*
*SAMPLE DIMENSION*
*4-3/16" X 8 3/4"*
FIG. 3
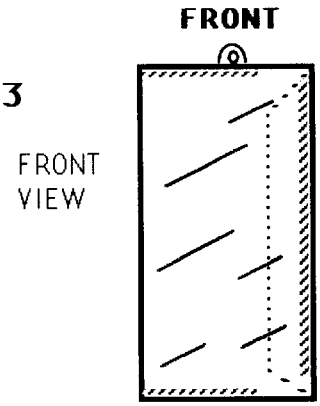
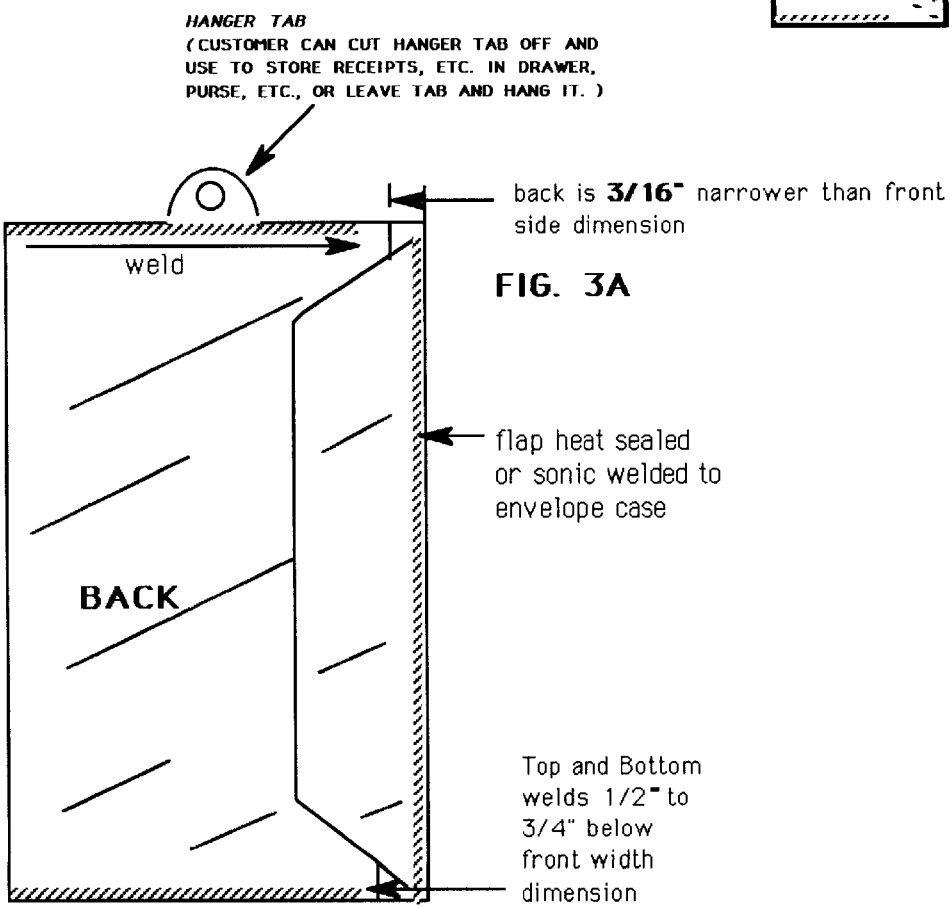
FIG. 3A PACKAGING EXAMPLES
(HANGING TAB CUT OFF TO USE PACKAGE AS ENVELOPE)
FIG. 4 FRONT VIEW
FIG. 4A BACK VIEW
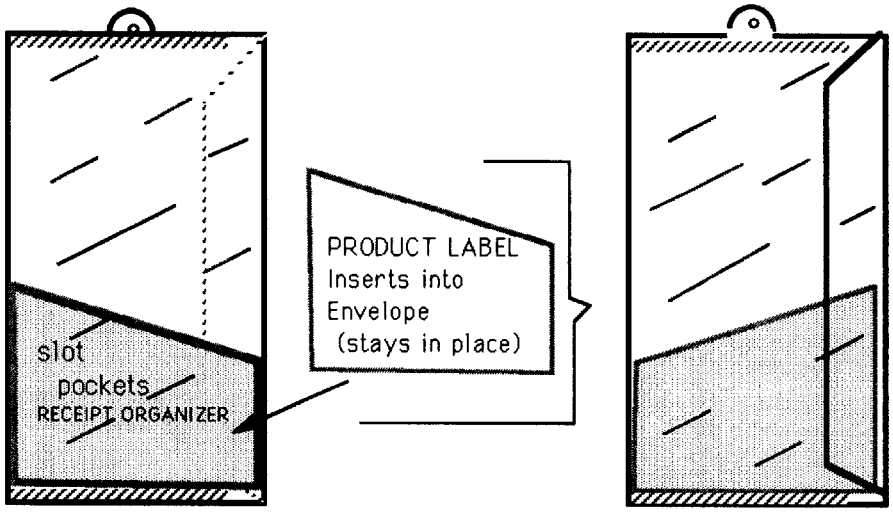
FIG. 4B FRONT
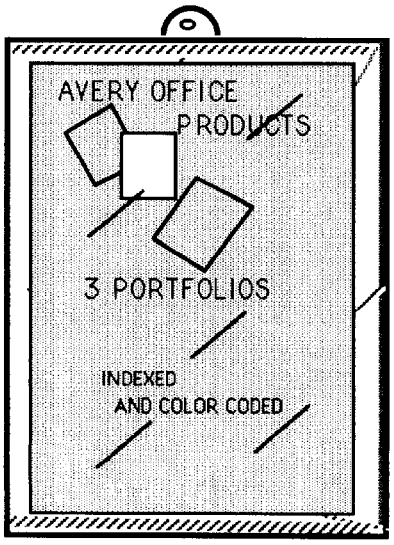
LARGER PRODUCT LABEL
(Inserted into envelope, (stays in place)
FIG. 4C BACK
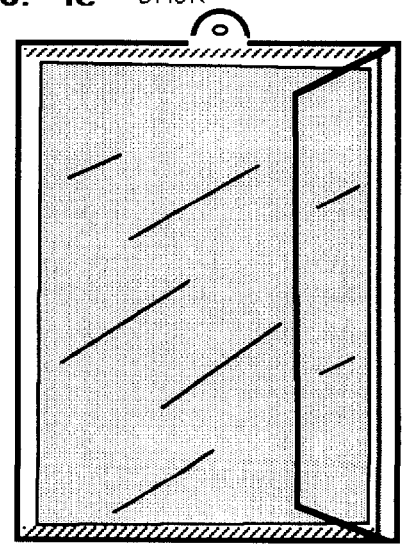

PACKAGING ENVELOPE
(ALTERNATE VIEW)

POLY-MATERIAL ENVELOPE ORGANIZER FOR RECEIPTS, COUPONS, AND/OR PACKAGE (RECYCLABLE) FOR FLAT PRODUCTS

CROSS-REFERENCE TO RELATED APPLICATIONS

Not Applicable

STATEMENT REGARDING FEDERALLY SPONSORED RESEARCH OR DEVELOPMENT

Not applicable

REFERENCE TO A MICROFICHE APPENDIX

Not Applicable

BACKGROUND OF THE INVENTION

1. Field of the Invention

Portfolio Envelope filing system for receipts, coupons and also a dual purpose use as recyclable packaging for flat surface products.

2. Background

Thompson U.S. Pat. No. 4,602,734:

This patent is specifically for use as a file folder for sheet paper that is maintained in a closed position by fabric type fasteners and has three non-connected edges. It is not made in such a way to accommodate coupons, and small pieces of paper such as receipts in an orderly fashion as it has no compartments to separate pieces of paper. Another disadvantage is that it has fabric fasteners and is not self-closing.

Carroll, III, U.S. Pat. No. 5,657,869

This invention is generally for use to package labels for computer magnetic diskettes, video tapes and audio tapes and as a reusable storage media for computer magnetic disketes, video tapes and audio tapes for consumers and for use in trade-shows as a display item. It has V-folds and accordion folds which create pages or leaves resembling a perfect bound book. It does not provide separable compartments with index tabs and labels to divide the contents within the embodiment. It is disadvantageous also because it has accordion folds which in its opened state is cumbersome in accessing contents.

Idstein, U.S. Pat. No. 5,125,561

This patent is specifically for use as a file folder for standard size sheet paper that is maintained in a closed position by punch-out fasteners and pocket flaps created by folding edges.

It is not made in such a way to accommodate coupons, and small pieces of paper such as receipts in an orderly fashion as it has no compartments to separate pieces of paper and no index tabs.

Hedge, U.S. Pat. No. 5,487,566

This patent discloses a combined advertising brochure and separable reusable envelope device formed from a rectangular sheet being portioned and folded through the application of parallel scorelines and perforation lines and also includes vertex fold points. It has a separable re-usable envelope at either end of the embodiment. This separable re-usable envelope has an accordion expansion with male and female tuck-in die cuts to hold it in a closed position. The separable re-usable envelope device on the Hedge patent is not constructed in such a way to accomodate coupons, and small pieces of paper such as receipts in an orderly fashion as it has no separable compartments within the embodiment to separate pieces of paper and identify them with index tabs. The fold-over flap with male and female tuck-in die cuts is difficult to close This method of closure has drawbacks as it is cumbersome to place the tuck-ins into the slits and if dropped it can flip open on impact.

Lee et al. U.S. Pat. No. 5,947,279 discloses an invention relating generally to storage and organization of documents and computer storage media. While this arrangement provides index tabs for identifcation and access to contents, this format is far from ideal as it is at least 1 and ½ inch thick in its empty state and becomes much thicker when full of contents. It is therefore cumbersome as respects portability in a clothing pocket, dayplanner or notebook. Also, it is disadvantageous because it has a rubberband type fastener which is not advantageous for storing in glove compartments or purses because it could catch on any other items in the purse or glove compartment, whereas the instant invention has a self-closing flap that lays flat.

SUMMARY OF THE INVENTION

The present invention provides a flexible, compact, protective portfolio-type organizer filing and storage system specifically for, but not limited to, small documents such as coupons and receipts. The invention has separable compartments with index tabs for the labeling of categories. The invention provides a thin, compact filing system that can be placed in a clothing pocket, glove compartment, notebook or any narrow or small area of space. A punched-out hole tab or tabs provides the capability of hanging from an office wall, or a display rack for marketing purposes or in a ring binder. To provide durability the construction material is polypropylene or other poly-type material. The invention has a self-closing flap mounted at the top, constructed of same polypropylene material which, due to the somewhat stiffness of material, creates a snap-back closing device. The bottom and sides of the portfolio organizer are closed creating a top-end opening with dividers and index tabs to identify contents within the embodiment. The dividers are heat welded together at the bottom thereby making the dividers a separate unit to provide removal of said dividers which provides an un-encumbered view of contents within the dividers when outside of the embodiment. To provide at-a-glance differentiation of categories the invention can be color coded.

The embodiment without dividers is for use as a storage envelope for single category documents. This single category use can have identification indicia imprinted on the envelope.

The invention has a dual purpose use as a package for flat-surfaced products. The self-closing flap can be placed on any side or top of the embodiment to allow for different configurations of products being held within. The use of invention as a package is ecologically sound as it can be used again as a sturdy, durable storage envelope instead of discarding the package.

The advantages of the invention are as follows:

1. The portfolio envelope provides a compact container for small documents that can easily be stored in a clothing pocket, purse, dayplanner, notebook, on a wall or any small area of space.

2. The invention has a self-closing flap which is compact and will not catch on anything.

3 The invention has dividers which gives the consumer a categorical identification of small documents such as ATM receipts and deposit slips which normally ends up in a pocket or purse that are easily lost or misplaced.

4. It can be color coded to provide identification of type of receipts or small documents, for example, storing Banking receipts . . . Blue, Green for Money, Purple for Coupons, etc.

5. The invention can include printed labels for each category of use, for example, for general type receipts labels will read, Department Store, Target, Wall-Mart, Home Improvement, etc. The consumer can choose from the list of labels for their own personal use.

6. The invention without the dividers provides a single category portfolio with or without identifying indicia and can be color coded also to provide identification of contents. The size makes it possible to fit it into a small desk drawer or other small area.

7. The invention in its use as package for flat surfaced products eliminates the need of stapling or glueing advertising indicia to package, it is a easily opened and can also be used as a portfolio instead of discarding the package which is an ecological solution to all of the plastic packages that are discarded.

DESCRIPTION OF VIEWS OF DRAWINGS

FIG. 1. FRONT VIEW OF ENVELOPE ORGANIZER.

FIG. 1A. SHOWS SCORING FOR USE TO EXPAND ENVELOPE.

FIG. 1B. BACK VIEW.

FIG. 2. SHOWS ENVELOPE IN OPENED STATE SHOWING TAB INDEX DIVIDERS.

FIG. 2A, B SHOWS TYPE OF INDEX TABS.

FIG. 2C INDEX TABBED DIVIDERS THAT ARE INSIDE ENVELOPE.

FIG. 3. FRONT VIEW OF ENVELOPE USED AS A (ECOLOGICAL) PACKAGE.

FIG. 3A. BACK VIEW-ECOLOGICAL PACKAGE

FIGS. 4–4C. PACKAGING EXAMPLES

FIG. 5. ALTERNATE VIEW OF PACKAGING ENVELOPE

FIG. 5A. VIEW SHOWING ANOTHER CONFIGURATION WITH PLURALITY OF TABS.

REFERENCE NUMERALS IN DRAWINGS

| | |
|---|---|
| 8 | Scoring Line |
| 9 | Dimension of Cover Flap |
| 10 | Cover Flap |
| 11 | Heat Welded for Cover Flap |
| 12 | Short Heat Weld |
| 13 | Long Heat Weld |
| 14 | Fold |
| 15 | Front |
| 16 | Dividers |
| 17 | Index Tab |
| 18 | Index Tab for Label Insertion |
| 19 | Punch-out Hole Tabs |
| 20 | Front of Re-usable package |
| 21 | Cover Flap of Re-Usable Package |
| 22 | Heat Welds |
| 23 | Back of Re-usable package |
| 24 | Adevertising Label-Front View |
| 25 | Advertising Label-Back View |
| 26 | Cover Flap in Raised Position |
| 27 | Product inserted into package |
| 28 | Cover Flap in raised position |

DETAILED DESCRIPTION OF THE INVENTION

In referring to the drawings as illustrated it shall be understood that the combined entities of FIGS. 1 thru 5 inclusive, are formed of polypropylene or other poly-type material capable of being imprinted with advertising, or indicia on all surfaces and capable of being repeatedly bent without fracturing. A number of embodiments of the invention are described in detail in the following paragraphs, with reference to the drawings, in which the elements in various figures are denoted by the reference numerals.

FIG. 1 shows the front view perspective of the portfolio organizer in its closed position. The construction of the embodiment of the portfolio organizer is composed of a rectilinear sheet of polypropylene material folded at the bottom 14 creating two open sides which sides are then closed by means of a heat weld 12,13 thereby creating three connected sides of the embodiment with one open side and said open side held closed by means of a cover flap 10 heat welded to the open end 11 of the back side 20 of portfolio to provide a fastening device.

Figure 5:
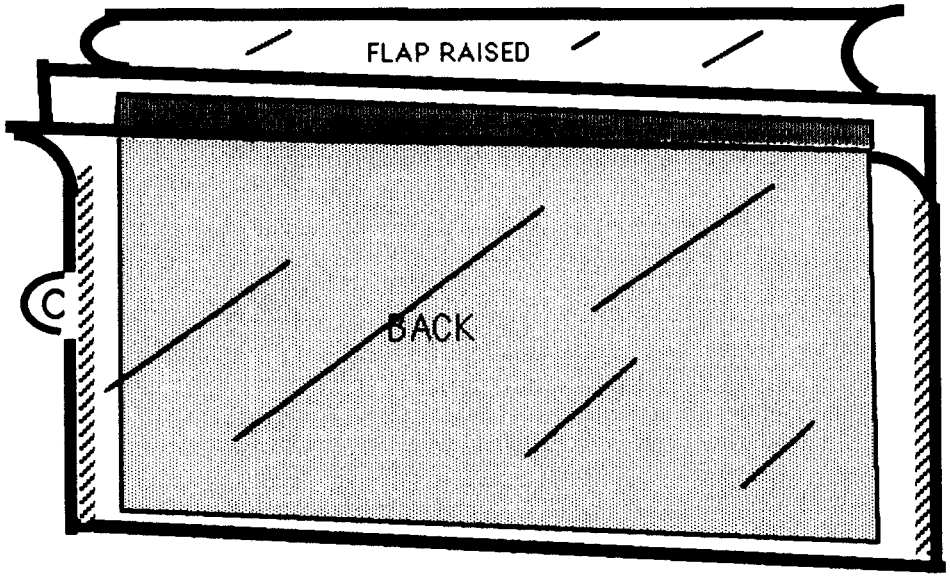

The top front opening side 15 of the portfolio is generally 3/16" shorter in height than the back 20 to allow mounting of the cover flap 10 to the back of the embodiment. The construction material is a pliable and yet somewhat stiff material therefore the mounting of cover flap by means of a heat weld creates a snap back effect thereby creating a self-closing cover flap that stays in a closed position unless lifted up to release the closure 28 (FIG. 5). The dimension of the flap 9 will vary according to the size of the portfolio to insure snug fit of contents. When the closure is released, the portfolio envelope can be opened wider one one side 12 due to the heat weld longitude being shorter than the heat weld on the opposite side of the portfolio envelope which accomodates a better viewing of contents. The opposite side of the portfolio is heat welded together 13 from the bottom of the side of the fold (14) to approximately ½" below the front top edge 15. This said heat weld measurement will vary in accordance with the size and type of contents in order to insure the snug fit of documents inside the embodiment. The cover flap in some cases, dependent upon thickness of material used, may have a score line to ease the pressure of the cover flap thereby expanding the envelope 8.

Figure 2:
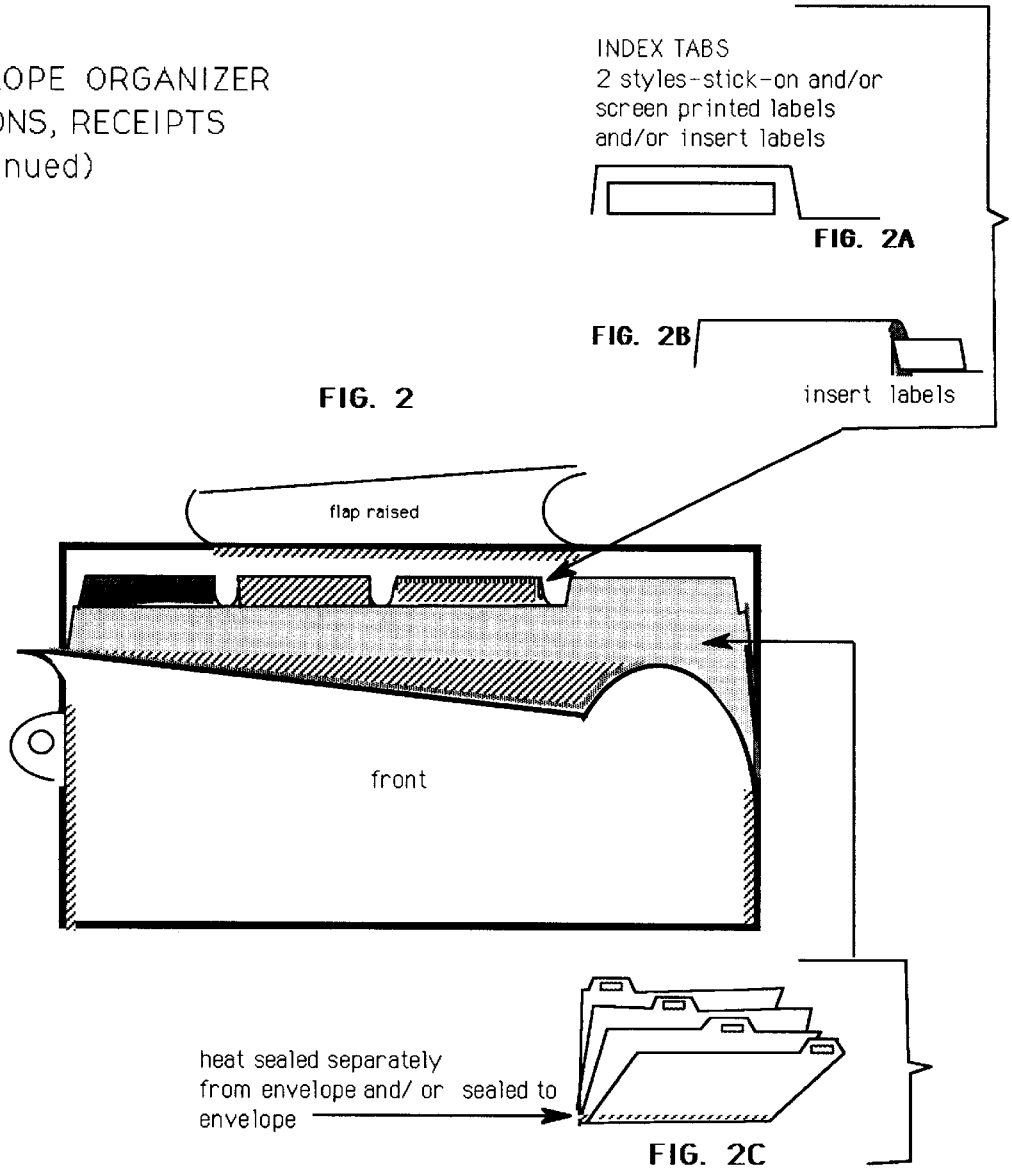

FIG. 2 Within the portfolio there are a plurality of dividers, usually three to four 16, made of same material, which said dividers are heat welded together at the bottom 16 (FIG. 2C), whereas the dividers being a free standing unit it makes it possible to remove the dividers from the portfolio encasing to provide a free-er space for perusal of enclosed papers if so desired. Each divider has index tabs to provide labeling of contents in each compartment. The index tabs are constructed in either of two ways, a flat surface to provide adhesive labels or screen printing on the surface 17 or a fold-over index tab 18 with said fold-over heat welded to the divider to provide a slot into which a label can be inserted 18 (FIG. 2B).

The portfolio has a punched-out hole tab or tabs 19 for the purpose of hanging from either a display rack for marketing purposes, to hang on a wall, or store in a ringbinder within a notebook This said tab is an inherent part of the design construction of the portfolio generally designed into the back side of portfolio on the top but can be applied to the side to accomodate a ring binder (FIG. 5A).

USE AS A RE-USABLE PACKAGE. FIG. 3 The invention in its use as a package for flat surfaced products is, in most cases transparent. The package is made in different dimensions to accomodate the product enclosed within the embodiment. In this instance the package has no dividers. The heat welds sealing the two ends 22 on the sides of the fold 14 extend longitudinally to the edge of opening of the back 23 of embodiment, however the length of these heat welds can be adapted to accomodate the product within the package. The cover flap 21 is mounted to the side of the front 20 or it can be mounted to the top with the sides heat welded and the fold on the bottom of enclosure, dependent upon product enclosed. The punch-out hole tab is applied to the top on the front 20 or back of the embodiment 23.

FIGS. 4–4C In its use as a re-usable package in most cases the invention is of a clear or transparent material in which the advertisement of the product 24 is inserted inside the package facing the front of the package along with the product itself 27 thereby providing a package that does not need any stapling or glueing. If the package is made of an opaque material the advertising labels or indicia can be applied to the outside of package by means of adhesive labels that can peel off.

What I claim as my invention is:

1. Portfolio organizer for use in organizing any type of small receipts, such as ATM receipts, coupons, money and other small documents to fit compactly in any small space such as a dayplanner, notebook, glove compartment, clothing pock-et or purse, comprised of:

a) a portfolio closed on three sides made of polypropylene or poly-type material which can include but is not limited to inclusion of b) a plurality of dividers with index tabs which said dividers are heat welded together at the bottom thereby creating a free standing unit to enable removal from portfolio, which portfolio is fastened together at the opening by means of a c) self-closing cover flap made of said same material mounted to the opening of embodiment by means of a heat weld which causes said flap to snap-back to a closed position when said flap is released from the raised open position, and c) a punch-out hole tab or tabs which is a part of the portfolio by means of the incorporated construction design of the portfolio which provides a means to hang the invention on a wall or place into a ring binder, which said tab can be removed if desired by cutting, thereby making the portfolio adaptable to any type of rectilinear storage within a container requiring all sides to be straight edges.

* * * * *